US006198228B1

(12) United States Patent
Nilssen

(10) Patent No.: US 6,198,228 B1
(45) Date of Patent: Mar. 6, 2001

(54) PLUG-IN FLUORESCENT LIGHTING SYSTEM

(76) Inventor: Ole K. Nilssen, Caesar Dr., Barrington, IL (US) 60010

( * ) Notice: Subject to any disclaimer, the term of this patent is extended or adjusted under 35 U.S.C. 154(b) by 0 days.

(21) Appl. No.: 08/552,672

(22) Filed: Nov. 3, 1995

Related U.S. Application Data

(63) Continuation of application No. 07/580,085, filed on Sep. 10, 1990, now abandoned, which is a continuation-in-part of application No. 06/787,692, filed on Oct. 15, 1985, now abandoned, which is a continuation of application No. 06/644,155, filed on Aug. 27, 1984, now abandoned, which is a continuation of application No. 06/555,426, filed on Nov. 23, 1983, now abandoned, which is a continuation of application No. 06/178,107, filed on Aug. 14, 1980, now abandoned.

(51) Int. Cl.[7] ..... H05B 37/02

(52) U.S. Cl. ..... 315/185 R; 315/324; 315/224; 362/133; 362/225

(58) Field of Search ..... 315/185 R, 189, 315/210, 250, 324, 242, 243, 224; 362/133, 225

(56) References Cited

U.S. PATENT DOCUMENTS 2,965,804 * 12/1960 Roesel, Jr. et al. ..... 315/324
4,001,571 * 1/1977 Martin ..... 362/225 X
4,005,335 * 1/1977 Perper ..... 315/DIG. 7
4,053,813 * 10/1977 Kornrumpf et al. ..... 315/206
4,060,752 * 11/1977 Walker ..... 315/244
4,127,795 * 11/1978 Knoll ..... 315/DIG. 7
4,134,045 * 1/1979 Quin ..... 315/324
4,257,088 * 3/1981 Nilssen ..... 315/243 X
4,262,327 * 4/1981 Kovscik et al. ..... 362/223
4,300,073 * 11/1981 Skwirut et al. ..... 315/53
4,441,055 * 4/1984 Balchjunas et al. ..... 315/189 X
4,677,345 * 6/1987 Nilssen ..... 315/209 R

* cited by examiner

*Primary Examiner*—Michael B. Shingleton

(57) ABSTRACT

A frequency-converting power supply is mounted on a power plug operable to be plugged into and held by an ordinary household electric power receptacle. Through an inductive internal impedance, the power supply provides a 20–40 kHz output voltage to a pair of output terminals that connect, by way of a female plug at the end of a light-weight power cord, with the input terminals of a fluorescent lamp assembly; across which input terminals is connected a capacitor of such capacitance value as to resonate with the power supply's inductive internal impedance, thereby providing the required lamp starting voltage and operating current. Also across the input terminals is connected a series-combination of a first instant-start fluorescent lamp and a special (normally shorted) female receptacle adapted to receive and disconnectably hold a special male plug; which, in turn, is connected with the terminals of a second instant-start fluorescent lamp. Thus, by way of disconnectable plug-receptacle means, one, two or more instant-start fluorescent lamps may be series-connected and properly started and operated from the frequency-converting plug-in power supply.

41 Claims, 3 Drawing Sheets

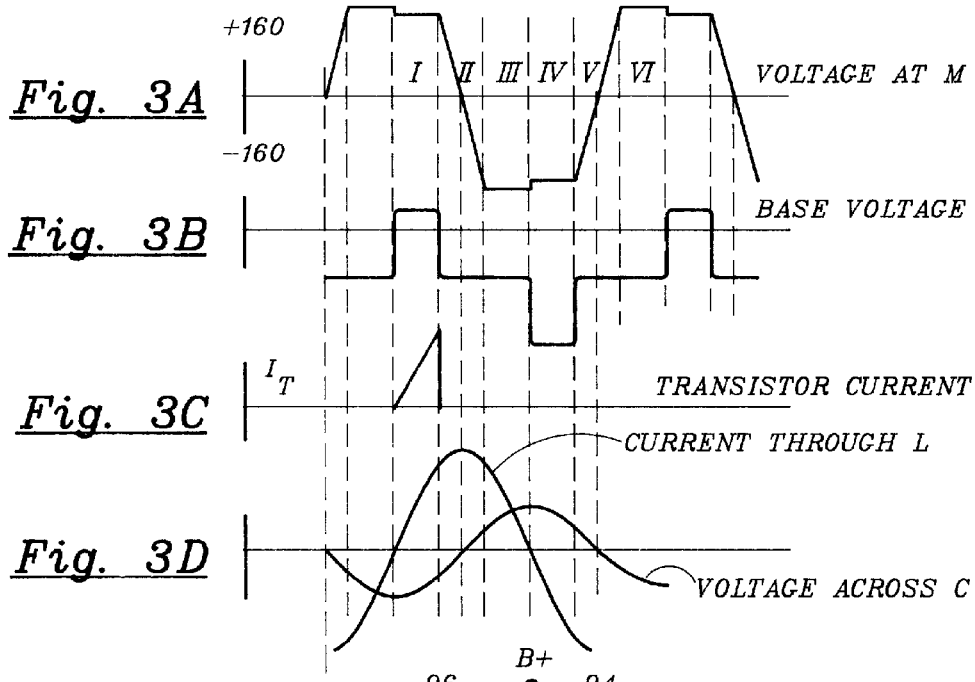
Fig. 3A
Fig. 3B
Fig. 3C
Fig. 3D
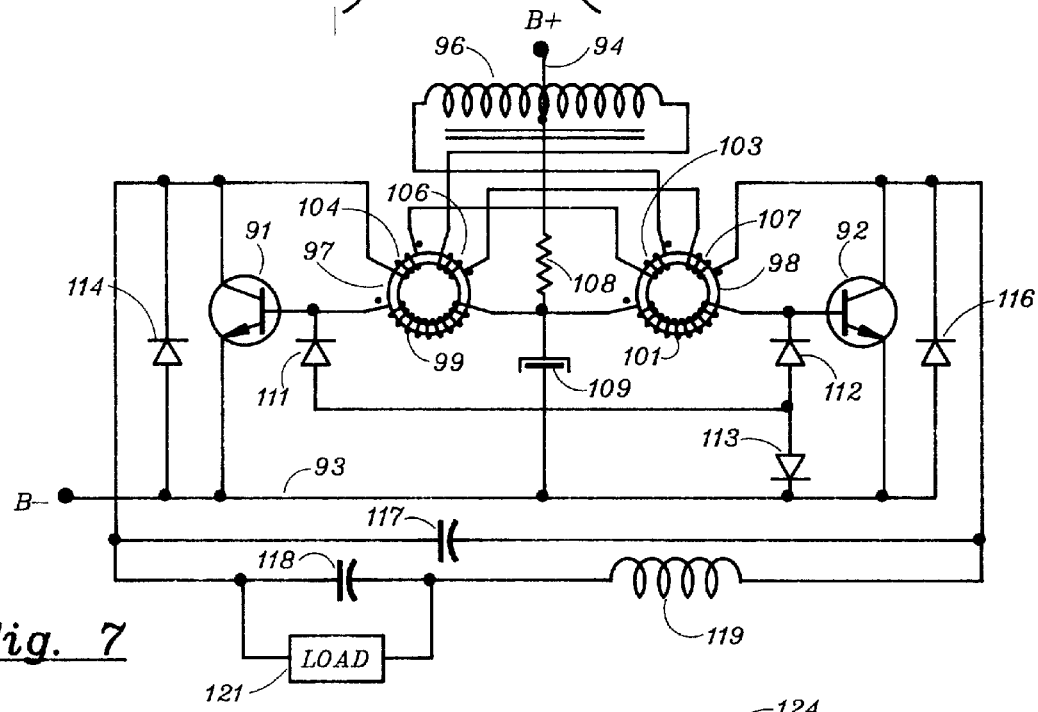
Fig. 7
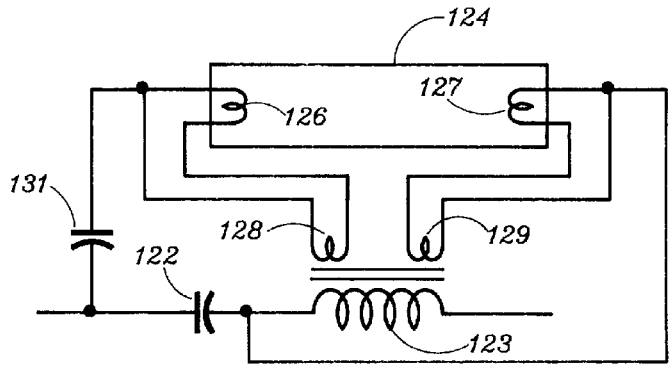
Fig. 8

PLUG-IN FLUORESCENT LIGHTING SYSTEM

BACKGROUND OF THE INVENTION

Related Applications

The present application is a continuation of Ser. No. 07,580,085 filed Sep. 10, 1990 now abandoned which is a Continuation-in-Part of Ser. No. 06/787,692 filed Oct. 15, 1985 now abandoned; which is a Continuation of Ser. No. 06/644,155 filed Aug, 27, 1984, now abandoned; which was a Continuation of Ser. No. 06/555,426 filed Nov. 23, 1983, now abandoned; which was a Continuation of Ser. No. 06/178,107 filed Aug. 14, 1980, now abandoned.

FIELD OF THE INVENTION

This invention relates to gas discharge lighting means, particularly of a type wherein one or more instant-start fluorescent lamps may be disconnectably series-connected and powered from a single plug-in frequency-converting power supply.

DESCRIPTION OF PRIOR ART

For a description of pertinent prior art, reference is made to U.S. Pat. No. 4,677,345 to Nilssen; which patent issued from a Division of application Ser. No. 06/178,107 filed Aug. 14, 1980; which application is the original progenitor of instant application.

Otherwise, reference is made to the following U.S. Patents: U.S. Pat. Nos. 3,263,122 to Genuit; 3,320,510 to Locklair; 3,996,493 to Davenport et el.; 4,100,476 to Ghiringhelli; 4,262,327 to Kovacik et al.; 4,370,600 to Zansky; 4,634,932 to Nilssen; and 4,857,806 to Nilssen.

SUMMARY OF THE INVENTION

Objects of the Invention

An object of the present invention is that of providing for a cost-effective gas discharge lighting system.

This as well as other objects, features and advantages of the present invention will become apparent from the following description and claims.

Brief Description

The present invention is directed to providing improved inverter circuits for powering and controlling gas discharge lamps. The inverter circuits according to the present invention are highly efficient, can be compactly constructed and are ideally suited for energizing gas discharge lamps, particularly "instant-start" and "self-ballasted" fluorescent lamps.

According to one form of the present invention, a series-connected combination of an inductor and a capacitor is provided in circuit with the inverter transistors to be energized upon periodic transistor conduction. Transistor drive current is preferably provided through the use of at least one saturable inductor to control the transistor inversion frequency to be equal to or greater than the nature resonant frequency of the inductor and capacitor combination. The high voltages efficiently developed by loading the inverter with the inductor and capacitor are ideally suited for energizing external loads such as gas discharge lamps. In such an application, the use of an adjustable inductor permits control of the inverter output as a means of adjusting the level of lamp illumination.

According to another important form of the present invention, reliable and highly efficient half-bridge inverters include a saturable inductor in a current feedback circuit to drive the transistors for alternate conduction. The inverters also include a load having an inductance sufficient to effect periodic energy storage for self-sustained transistor inversion. Importantly, improved reliability is achieved because of the relatively low and transient-free voltages across the transistors in these half-bridge inverters.

Further, according to another feature of the present invention, novel and economical power supplies particularly useful with the disclosed inverter circuits convert conventional AC input voltages to DC for supplying to the inverters.

In a still different form, the present invention features a frequency-converting power supply mounted on a power plug operable to be plugged into and held by an ordinary household electric power receptacle. Through an inductive internal impedance, this power supply provides a 20–40 kHz output voltage to a pair of output terminals that connect, by way of a female plug at the end of a light-weight power cord, with the input terminals of a fluorescent lamp assembly; across which input terminals is connected a capacitor of such capacitance value as to resonate with the power supply's inductive internal impedance, thereby providing the required lamp starting voltage and operating current. Also across the input terminals is connected a series-combination of a first instant-start fluorescent lamp and a special (self-shorting) female receptacle means adapted to receive and disconnectably hold a special male plug; which, in turn, is connected with the terminals of a second instant-start fluorescent lamp. Thus, by way of disconnectable plug-receptacle means, one, two or more instant-start fluorescent lamps may be series-connected and properly started and operated from the frequency-converting plug-in power supply.

BRIEF DESCRIPTION OF THE DRAWINGS

FIGS. 3A–3D is a set of waveform diagrams of certain significant voltages and currents occurring in the circuit of FIG. 2;

FIG. 7 is an alternate form of push-pull inverter circuit accordind to the present invention;

FIG. 8 is a schematic diagram showing the connection of a gas discharge lamp of the "rapid-start" type to an inductor-capacitor-loaded inverter according to the present invention.

DESCRIPTION OF THE PREFERRED EMBODIMENTS

Figure 1:
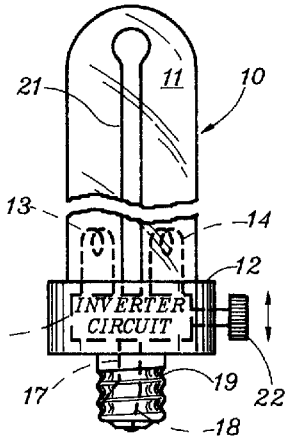
FIG. 1 is a front elevation of a folded fluorescent lamp unit adapted for screw-in insertion into a standard Edison incandescent socket.

FIG. 1 illustrates a screw-in gas discharge lamp unit 10 comprising a folded fluorescent lamp 11 suitably secured to an integral base 12. The lamp comprises two cathodes 13, 14 which are supplied with the requisite high operating voltage from a frequency-converting power supply and ballasting circuit 16; which, because of its compact size, conveniently fits within the base 12.

The inverter circuit 16 is connected by leads 17, 18 to a screw-type plug 19 adapted for screw-in insertion into a standard Edison-type incandescent lamp socket at which ordinary 120 Volt/60 Hz power line voltage is available. A ground plane comprising a wire or metallic strip 21 is disposed adjacent a portion of the fluorescent lamp 11 as a starting aid. Finally, a manually rotatable external knob 22 is connected to a shaft for mechanical adjustment of the air gap of a ferrite core inductor to vary the inductance value thereof in order to effect adjustment of the inverter voltage output connected to electrodes 13, 14 for controlled variation of the lamp illumination intensity.

Figure 2:
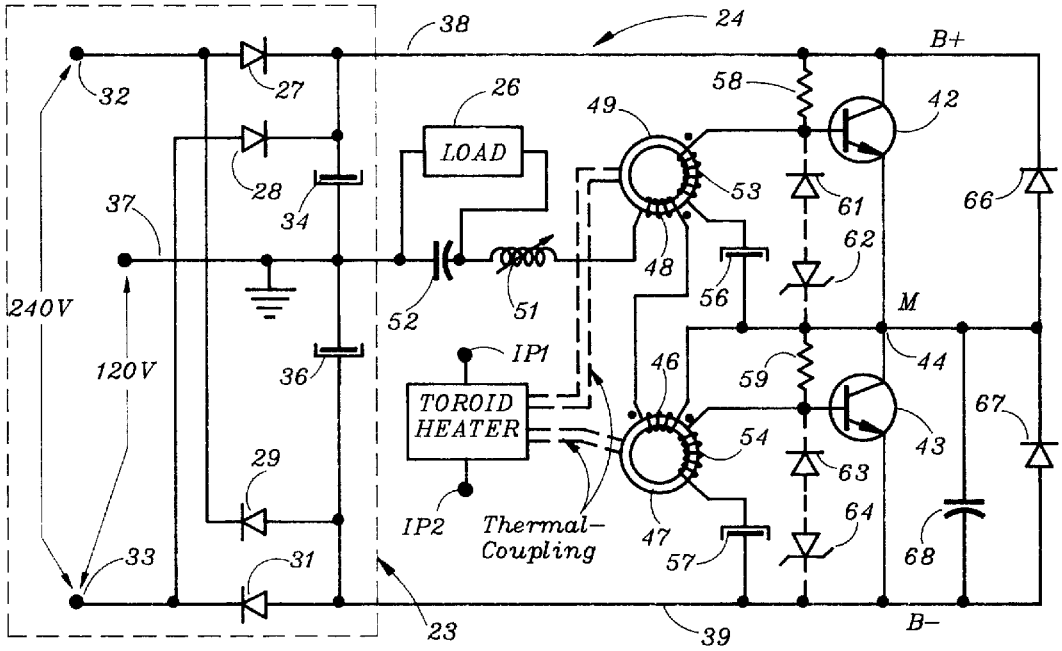
FIG. 2 is a schematic diagram illustrating the essential features of a push-pull inverter circuit particularly suitable for energizing the lamp unit of FIG. 1.

With reference to FIG. 2, a power supply 23, connected to a conventional AC input, provides a DC output for supplying a high-efficiency inverter circuit 24. The inverter is operable to provide a high voltage to an external load 26, which may comprise a gas discharge device sich as the fluorescent lamp 11 of FIG. 1.

The power supply 23 comprises bridge rectifier having four diodes 27, 28, 29 and 31 connectable to a 240 volt AC supply at terminals 32, 33. Capacitors 34, 36 are connected between a ground line 37 (in turn directly connected to the inverter 24) and to a B+ line 38 and a B− line 39, respectively. The power supply 23 also comprises a voltage doubler and rectifier optionally connectable to a 120 volt AC input taken between the ground line 37 and terminal 33 Or 32. The voltage doubler and rectifier means provides a direct electrical connection by way of line 37 netween one of the 120 volt AC power input lines and the inverter 24, as shown in FIG. 2. The bridge rectifier and the voltage doubler and rectifier provide substantially the same DC output voltage to the inverter 24 whether the AC input is 120 or 240 volts. Typical voltages are +160 volts on the B+ line 38 and −160 volts on the B− line 39.

Figure 4:
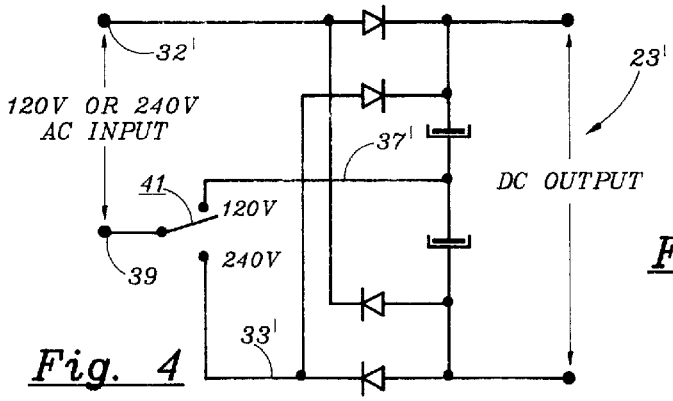
FIG. 4 is a schematic diagram of a DC power supply connectable to both 120 and 240 volt AC inputs.

With additional reference to FIG. 4, which shows an alternate power supply 23', the AC input, whether 120 or 240 volts, is provided at terminals 32' and 39. Terminal 39 is in turn connected through a single-pole double-throw selector switch 41 to terminal 37' (for 120 volt operation) or terminal 33' (for 240 volt operation). In all other respects, power supplies 23 and 23' are identical.

The inverter circuit 24 of FIG. 2 is a half-bridge inverter comprising transistors 42, 43 connected in series across the DC voltage output of the power supply 23 on B+ and B− lines 38 and 39, respectively. The collector of trasistor 42 is connected to the B+ line 38, the emitter of transistor 42 and the collector of transistor 43 are connected to a midpoint line 44 (designated "M") and the emitter of transistor 43 is connected to the B− line 39. The midpoint line 44 is in turn connected to the ground line 37 through primary winding 46 of a toroidal saturable core transformer 47, a primary winding 48 on an identical transformer 49, an inductor 51 and a series-connected capacitor 52. The inductor 51 and capacitor 52 are energized upon alternate transistor conduction in a manner to be described later.

An external load 26 is preferably taken off capacitor 52, as shown in FIG. 2. The inductor 51, preferably a known ferrite core inductor, has an inductance variable by mechanical adjustment of the air gap in order to effect variation in the level of the inductor and capacitor voltage and hence the power available to the load, as will be described. When the load is a gas discharge lamp such as lamp 11 in FIG. 1, variation in this inductance upon rotation of knob 22 accomplishes a lamp dimming effect.

Drive current to the base terminals of transistors 42 and 43 is provided by secondary windings 53, 54 of transformers 49, 47, respectively. Winding 53 is also connected to midpoint lead 44 through a bias capacitor 56, while winding 54 is connected to the B− lead 39 through an identical bias capacitor 57. The base terminals of transistors 42 and 43 are also connected to lines 38 and 44 through bias resistors 58 and 59, respectively. For a purpose to be described later, the base of transistor 42 can be optionally connected to a diode 61 and a series Zener diode 64 in turn connected to the midpoint line 44; similarly, a diode 63 and series Zener diode 64 in turn connected to the B− line 39 can be connected to the base of transistor 43. Shunt diodes 66 and 67 are connected across the collector-emitter terminals of transistors 42 and 43, respectively. Finally, a capacitor 68 is connected across the collector-emitter terminals of transistor 43 to restrain the rate of voltage rise across those terminals, as will be seen presently.

The operation of the circuit of FIG. 2 can best be understood with additional reference to FIG. 3, which illustrates significant portions of the waveforms of the voltage at midpoint M (FIG. 3A), the base-emitter voltage on transistor 42 (FIG. 3B), the current through transistor 42 (FIG. 3C), and the capacitor 52 voltage and the inductor 51 current (FIG. 3D).

Assuming that transistor 42 is first to be triggered into conduction, current flows from the B+ line 38 through windings 46 and 38 and the inductor 51 to charge capacitor 52 and returns through capacitor 34 (refer to the time period designated I in FIG. 3). When the saturable inductor 49 saturates at the end of period I, drive current to the base of transistor 42 will terminate, causing voltage on the base of the transistor to drop to the negative voltage stored on the bias capacitor 56 in a manner to be described, causing this transistor to become non-conductive. As shown in FIG. 3*c*, current-flow in transistor 43 terminates at the end of period I.

Because the current through inductor 51 cannot change instantaneously, current will flow from the B− bus 39 through capacitor 68, causing the voltage at midpoint line 44 to drop to −160 volts (period II in FIG. 3). The capacitor 68 restrains the rate of voltage change across the collector and emitter terminals of transistor 42. The current through the inductor 51 reaches its maximum value when the voltage at the midpoint line 44 is zero. During period III, the current will continue to flow through inductor 51 but will be supplied from the B-bus through the shunt diode 67. It will be appreciated that during the latter half of period II and all of period III, positive current is being drawn from a negative voltage; which, in reality, means that energy is being returned to the power supply through a path of relatively low impedance.

When the inductor current reaches zero at the start of period IV, the current through the primary winding 46 of the saturable inductor 47 will cause a current to flow out of its secondary winding 54 to cause transistor 43 to become conductive, thereby causing a reversal in the direction of current through inductor 51 and capacitor 52. When transformer 47 saturates at the end of period IV, the drive current to the base of transistor 43 terminates and the current through inductor 51 will be supplied through capacitor 68, causing the voltage at midpoint line 44 to rise (period V). When the voltage at the midpoint line M reaches 160 volts, the current will then flow through shunt diode 66 (period VI). The cycle is then repeated.

As seen in FIG. 3, saturable transformers 47, 49 provide transistor drive current only after the current through inductor 51 has diminished to zero. Further, the transistor drive current is terminated before the current through inductor 51 has reached its maximum amplitude. This coordination of base drive current and inductor current is achieved because of the series-connection between the inductor 51 and the primary windings 46, 48 of saturable transformers 47, 49, respectively.

The series-connected combination of the inductor 51 and the capacitor 52 is energized upon the alternate conduction of transistors 42 and 43. With a large value of capacitance of capacitor 52, very little voltage will be developed across its terminals. As the value of this capacitance is decreased, however, the voltage across this capacitor will increase. As the value of the capacitor 52 is reduced to achieve resonance with the inductor 51, the voltage on the capacitor will rise and become infinite in a loss-free circuit operating under ideal conditions.

It has been found desirable to regulate the transistor inversion frequency, determined mainly by the saturation time of the saturable inductors 47, 49, to be equel to or higher than the natural resonance frequency of the inductor and capacitor combination in order to provide a high voltage output to external load 26. A high voltage across capacitor 52 is efficiently developed as the transistor inversion frequency approaches the natural resonant frequency of the inductor 51 and capacitor 52 combination. Stated another way, the conduction period of each transistor is desirably shorter in duration than one quarter of the full period corresponding to the natural resonant frequency of the inductor and capacitor combination. When the inverter 24 is used with a self-ballasted gas discharge lamp unit, it has been found that the inversion frequency can be at least equal to the natural resonant frequency of the tank circuit. If the capacitance value of capacitor 52 is reduced still further beyond the resonance point, unacceptably high transistor currents will be experienced during transistor switching and transistor burn-out will occur.

It will be appreciated that the sizing of capacitor 52 is determined by the application of the inverter circuit 24. Variation in the values of the capacitor 52 and the inductor 51 will determine the voltages developed in the inductor-capacitor tank circuit. The external load 26 may be connected in circuit with the inductor 51 (by a winding on the inductor, for example) and the capacitor may be omitted entirely. If the combined circuit loading of the inductor 51 and the external load 26 has an effective inductance of value sufficient to effect periodic energy storage for self-sustained transistor inversion, the current feedback provided by the saturable inductors 47,49 will effect alternate transistor conduction without the need for additional voltage feedback. When the capacitor 52 is omitted, the power supply 23 provides a direct electrical connection between one of the AC power input lines and the inverter load circuit.

Because the voltages across transistors 42, 43 are relatively low (due to the effect of capacitors 34, 36), the half-bridge inverter 24 is very reliable. The absence of switching transients minimizes the possibility of transistor burn-out.

The inverter circuit 24 comprises means for supplying reverse bias to the conducting transistor upon saturation of its associated saturable inductor. For this purpose, the capacitors 56 and 57 are charged to negative voltages as a result of reset current flowing into secondary windings 53, 54 from the bases of transistors 42, 43, respectively. This reverse current rapidly turns off a conducting transistor to increase its switching speed and to achieve inverter circuit efficiency in a manner described more fully in my co-pending U.S. patent application Ser. No. 103,624 filed Dec. 14, 1979 and entitled "Bias Control for High Efficiency Inverter Circuit" (now U.S. Pat. No. 4,307,353). The more negative the voltage on the bias capacitors 56 and 57, the more rapidly charges are swept out of the bases of their associated transistors upon transistor turn-off.

When a transistor base-emitter junction is reversely biased, it exhibits the characteristics of a Zener diode having a reverse breakdown voltage on the order of 8 to 14 Volt for transistors typically used in high-voltage inverters. As an alternative, to provide a negative voltage smaller in magnitude on the base lead of typical transistor 42 during reset operation, the optional diode 61 and Zener diode 62 combination can be used. For large values of the bias capacitor 56, the base voltage will be substantially constant.

If the load 26 comprises a gas discharge lamp, the voltage across the capacitor 52 will be reduced once the lamp is ignited to prevent voltages on the inductor 51 and the capacitor 52 from reaching destructive levels. Such a lamp provides an initial time delay during which a high voltage, suitable for instant starting, is available.

Figure 5:
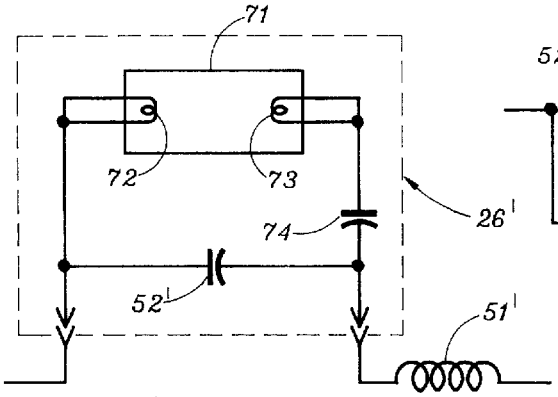
FIG. 5 is a schematic diagram which illustrates the connection of a non-self-ballasted gas discharge lamp unit to the FIG. 2 inverter circuit.

FIG. 5 illustrates the use of an alternate load 26' adapted for plug-in connection to an inverter circuit such as shown in FIG. 2. The load 26' consists of a gas discharge lamp 71 having electrodes 72, 73 and connected in series with a capacitor 74. The combination of lamp 71 and capacitor 74 is connected in parallel with a capacitor 52' which serves the same purpose as capacitor 52 in the FIG. 2 circuit. However, when the load 26' is unplugged from the circuit, the inverter stops oscillating and the development of high voltages in the inverter is prevented. The fact that no high voltages are generated by the circuit if the lamp is disconnected while the circuit is oscillating is important for safety reasons.

Figure 6:
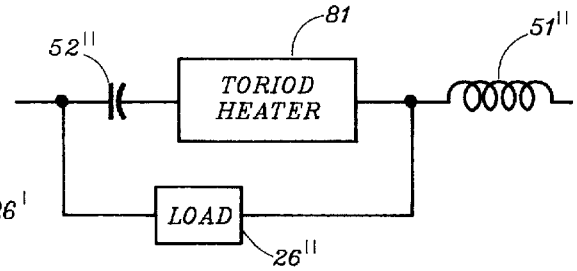
FIG. 6 is a schematic diagram which illustrates the use of a toroid heater for regulation of the inverter output.

FIG. 6 illustrates a capacitor 52" connected in series with an inductor 51" through a heater 81 suitable for heating the toroidal inductors 47, 49 in accordance with the level of output. The load 26" is connected across the series combination of the capacitor 52" and the toroid heater. The heater 81 is preferably designed to controllably heat the toroidal saturable inductors in order to decrease their saturation flux limit and hence their saturation time. The result is to decrease the periodic transistor conduction time and thereby increase the transistor inversion frequency. When a frequency-dependent impedance means, that is, an inductor or a capacitor, is connected in circuit with the AC voltage output of the inverter, change in the transistor inversion frequency will modify the impedance of the frequency-dependent impedance means and correspondingly modify the inverter output. Thus as the level of the output increases, the toroid heater 81 is correspondingly energized to effect feedback regulation of the output. Further, transistors 42, 43 of the type used in high voltage inverters dissipate heat during periodic transistor conduction. As an alternative, the toroid heater 81 can use this heat for feedback regulation of the output or control of the temperature of transistors 42, 43.

The frequency dependent impedance means may also be used in a circuit to energize a gas discharge lamp at adjustable illumination levels. Adjustment in the inversion frequency of transistors 42, 43 results in control of the magnitude of the AC current supplied to the lamp. This is preferably accomplished where saturable inductors 47, 49 have adjustable flux densities for control of their saturation time.

FIG. 7 schematically illustrates an alternate form of inverter circuit, shown without the AC to DC power supply connections for simplification. In this Figure, the transistors are connected in parallel rather than in series but the operation is essentially the same as previously described.

In particular, this circuit comprises a pair of alternately conducting transistors 91, 92. The emitter terminals of the transistors are connected to a B− line 93. A B+ lead 94 is connected to the center-tap of a transformer 96. In order to provide drive current to the transistors 91, 92 for control of their conduction frequency, saturable inductors 97, 98 have secondary windings 99, 101, respectively, each secondary winding having one end connected to the base of its associated transistor; the other ends are connected to a common terminal 102. One end of transformer 96 is connected to the collector of transistor 91 through a winding 103 on inductor 98 in turn connected in series with a winding 104 on inductor 97. Likewise, the other end of transformer 96 is connected to the collector of transistor 92 through a winding 106 on inductor 97 in series with another winding 107 on inductor 98.

The B+ terminal is connected to terminal 102 through a bias resistor 108. A bias capacitor 109 connects terminal 102 to the B− lead 93. This resistor and capacitor serve the same function as resistors 58, 59 and capacitors 56, 57 in the FIG. 2 circuit.

The bases of transistors 91, 92 are connected by diodes 111, 112, respectively, to a common Zener diode 113 in turn connected to the B− lead 93. The common Zener diode 113 serves the same function as individual Zener diodes 62, 64 in FIG. 2.

Shunt diodes 114, 116 are connected across the collector-emitter terminals of transistors 91, 92, respectively. A capacitor 117 connecting the collectors of transistors 91, 92 restrains the rate of voltage rise on the collectors in a manner similar to the collector-emitter capacitor 68 in FIG. 2.

Inductive-capacitive loading of the FIG. 7 inverter is accomplished by a capacitor 118 connected in series with with an inductor 119, the combination being connected across the collectors of the transistors 91, 92. A load 121 is connected across the capacitor 118.

FIG. 8 illustrates how an inverter loaded with a series capacitor 122 and inductor 123 can be used to energize a "rapid-start" fluorescent lamp 124 (the details of the inverter circuit being omitted for simplication). The lamp 124 has a pair of cathodes 126, 127 connected across the capacitor 122 for supply of operating voltage in a manner identical to that previously described. In addition, the inductor 123 comprises a pair of magnetically-coupled auxiliary windings 128, 129 for electrically heating the cathodes 126, 127, respectively. A small capacitor 131 is connected in series with lamp 124.

Figure 9:
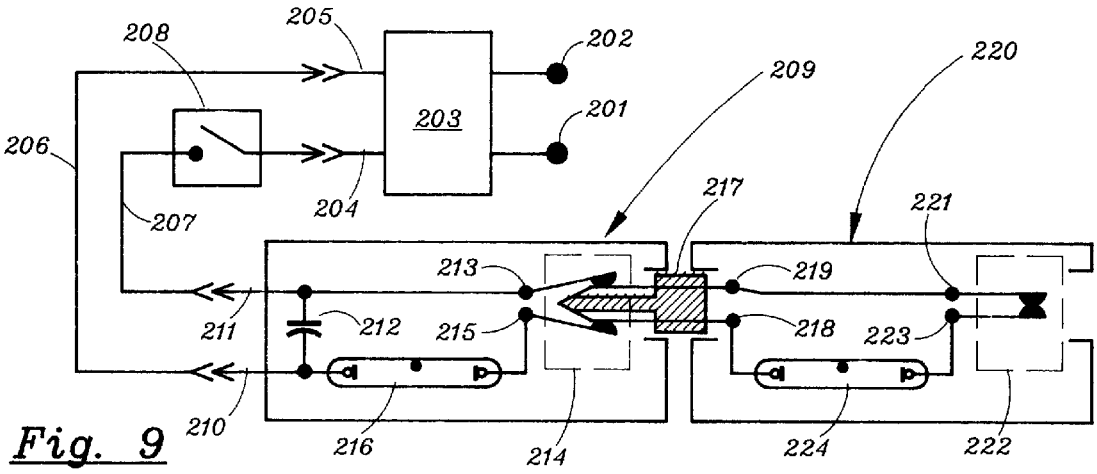
FIG. 9 schematically shows the main elements of a lighting system having plug-in frequency-converting power supply and plural series-connectable instant-start fluorescent lamps.

FIG. 9 illustrates a unique application of the inverter power supply circuit of FIG. 2 as combined with the connect-disconnect arrangement of FIG. 5.

More particularly, in FIG. 9 120 Volt/60 Hz power line voltage from an ordinary electric utility power line is applied to power input terminals 201, 202 of a frequency-converting power supply 203; which frequency-converting power supply conditionally provides a high frequency (20–40 kHz) output current from its output terminals 204, 205.

Disconnectably connected with output terminals 204, 205 is a pair of power conductors 206, 207; which power conductor 207 has a switch 208. A first lamp assembly 209 has a pair of power input terminals 210, 211; which power input terminals are disconnectably connected with power conductors 206, 207.

Within lamp assembly 209, a capacitor 212 is connected directly across terminals 210, 211; which terminal 211 is connected directly with terminal 213 of a special combination switch and receptacle means 214; which switch/receptacle means 214 also has a second terminal 215. An instant-start fluorescent lamp 216 is connected between terminals 210 and 215.

Switch/receptable means 214 is of such nature as to provide for an electrical short circuit to exist between its terminals 213, 215, except when a special plug 217 is inserted into it (as shown). Special plug 217, which is connected with a second lamp assembly 220, has two terminals 218, 219; which terminal 219 is connected with a terminal 221 of another special combination switch and receptacle means 222. Switch/receptacle means 222 also has a terminal 223; and an instant-start fluorescent lamp 224 is connected between terminals 218 and 223. Like switch/receptacle means 214, switch/receptacle means 222 is of such nature as to provide for an electrical short circuit to exist between its terminals 221, 223, except when a special plug—like special plug 217—is inserted thereinto.

With switch 208 in its closed position, the pair of power conductors 206, 207, when connected with the first lamp assembly 209 (combined with any and all additional lamp assemblies plugged into its switch/receptacle means 214), represents the load for the frequency-converting power supply 203, just like load 26' of FIG. 5 represents the load on an inverter circuit like that of FIG. 2 with capacitor 52 and load 26 removed. That is, the frequency-converting power supply 203 is substantially identical to the circuit arrangement of FIG. 1, except with tank capacitor 52 and load 26 removed. Also, terminals 37 and 33 of FIG. 2 would be equivalent to terminals 201 and 202 of FIG. 9.

With switch 208 closed, a tank inductor within frequency-converting power supply 203 (i.e., a tank inductor equivalent to inductor 51 of FIG. 2) resonates with the capacitance of capacitor 212, thereby—due to so-called Q-multiplication—causing a high-magnitude high-frequency voltage to develop across tank capacitor 212. Eventually, the magnitude of this high-frequency voltage reaches a level sufficient to ignite series-connected lamps 216 and 224 (as well as any additional series-connected lamps).

Thus, with a sufficiently high circuit Q-factor, the magnitude of the high-frequency voltage across tank capacitor 212 will increase to whatever point is required to cause the lamps to ignite. Thereafter, the lamps will be powered with a current of magnitude determined by the particular value of the inductance included within frequency-converting power supply 203 (i.e., its internal inductive impedance) as combined with the particular value of the capacitance of tank capacitor 212.

Of course, with switch 208 in its open position, the inverter within the frequency-converting power supply 203 is prevented from operating.

If, while the lamps are both operating, lamp assembly 224 were to be unplugged from switch/receptacle means 214 on lamp assembly 209, lamp 224 would extinguish, but lamp 216 would continue to be lit. In fact, due to the basic nature of the parallel-loaded series-excited inverter—which is what the half-bridge inverter circuit of FIG. 2 actually represents—the magnitude of the current supplied to lamp 216 changes very little with the removal of (or with the addition of) lamp 224.

Thus, with the arrangement of FIG. 9, any number (up to some maximum number) of lamp assemblies may be plugged into each other and be properly ignitied and operated: the maximum permissible number depending on particulatr design details. For instance, using 12" T-5 fluorescent lamps, a total of twelve series-connected lamps can readily be ignited and properly powered from a single frequency-converting power supply small enough to be built in integral combination with a power plug suitable for direct plug-in connection into and support by an ordinary household electric receptacle.

Figure 10:
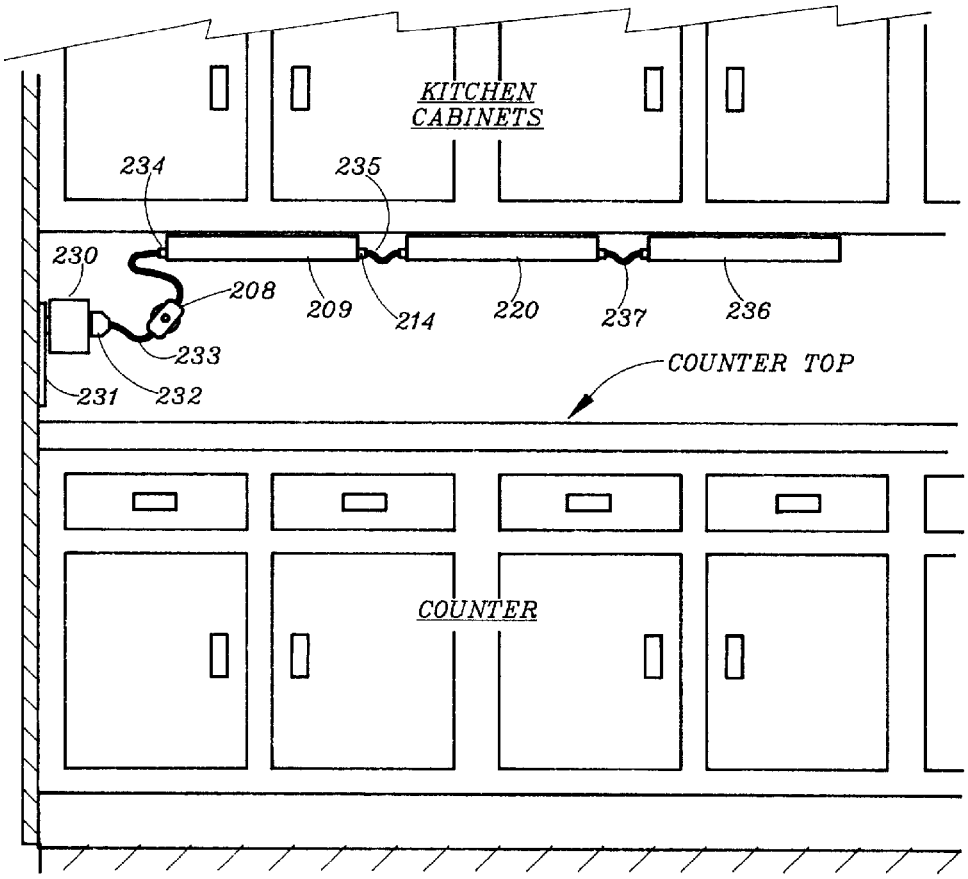
FIG. 10 shows the lighting system of FIG. 9 as it actually might be installed under some kitchen cabinets in a home.

FIG. 10 illustrates an example of an application of the lighting system of FIG. 9. In FIG. 10, the frequency-converting power supply 203 of FIG. 9 is built into an over-sized power plug 230, which is plugged into and held by household electric receptacle 231 mounted on a wall in a kitchen between a counter-top and some kitchen cabinets. Plugged into over-sized power plug 230 is a small power plug 232; which, via power cord 233 (which includes power conductors 206, 207 as well as switch 208) and female plug means 234, is plugged into first lamp assembly 209; which is mounted under the kitchen cabinets. Second lamp assembly 220 is plugged into switch/receptacle means 214 by way of a connect cord 235; and a third lamp assembly 236 is plugged into lamp assembly 209 by way of a connect cord 237.

The first lamp assembly 209, which is the only one of the plural lamp assemblies which includes the tank capacitor, may sometimes hereinafter be referred-to as the master lamp assembly.

Additional Explanations and Comments (a) With reference to FIGS. 2 and 5, adjustment of the amount of power supplied to load 26', and thereby the amount of light provided by lamp 71, may be accomplished by applying a voltage of adjustable magnitude to input terminals IP1 and IP2 of the Toroid Heater; which is thermally coupled with the toroidal ferrite cores of saturable transformers 47, 49.

(b) With reference to FIGS. 9 and 10, each switch/receptacle means (such as element 214) is characterized by providing for a short circuit between its terminals (i.e., 213, 215) except if or when a special plug (i.e., one such as plug 217) is inserted into this switch/receptacle means such as to pry apart two spring-loaded conductive elements comprised therewithin. Thus, each time one lamp assembly (such as lamp assembly 220) is plugged into another lamp assembly (such as lamp assembly 209), the fluorescent lamp of the first lamp assembly (i.e., lamp 224) becomes series-connected with the fluorescent lamp of the second lamp assembly (i.e., lamp 216).

(c) With commonly available components, inverter circuit 24 of FIG. 2 can be made to operate efficiently at any frequency between a few kHz to perhaps as high as 50 kHz. However, for various well-known reasons (i.e., eliminating audible noise, minimizing physical size, and maximizing efficiency), the frequency actually chosen is in the range of 20 to 40 kHz.

(d) The fluorescent lighting unit of FIG. 1 could be made in such manner as to permit fluorescent lamp 11 to be disconnectable from its base 12 and ballasting means 16. However, if powered with normal line voltage without its lamp load connected, frequency-converting power supply and ballasting circuit 16 is apt to self-destruct.

To avoid such self-destruction, arrangements can readily be made whereby the very act of removing the load automatically establishes a situation that prevents the possible destruction of the power supply and ballasting means. For instance, with the tank capacitor (52) being permanently connected with the lamp load (11)—thereby automatically being removed whenever the lamp is removed—the inverter circuit is protected from self-destruction.

(e) At frequencies above a few kHz, the load represented by a fluorescent lamp—once it is ignited—is substantially resistive. Thus, with the voltage across lamp 11 being of a substantially sinusoidal waveform (as indicated in FIG. 3*d*), the current through the lamp will also be substantially sinusoidal in waveshape.

(f) In the fluorescent lamp unit of FIG. 1, fluorescent lamp 11 is connected with power supply and ballasting circuit. 16 in the exact same manner as is load 26 connected with the circuit of FIG. 2. That is, it is connected in parallel with the tank capacitor (52) of the L-C series-resonant circuit. As is conventional in instant-start fluorescent lamps—such as lamp 11 of FIG. 1—the two terminals from each cathode are shorted together, thereby to constitute a situation where each cathode effectively is represented by only a single terminal. However, it is not necessary that the two terminals from each cathode be shorted together; in which case—for instant-start operation—connection from a lamp's power supply and ballasting means need only be made with one of the terminals of each cathode.

(g) With respect to FIGS. 9 and 10, in any of the plural lamp assemblies (such as lamp assembly 209), the fluorescent lamp (ex: lamp 216) may in fact consist of two or more series-connected instant-start lamps. Thus, a lamp assembly may be configured in any one of a variety of ways: as a single straight fluorescent lamp; as plural parallel-placed (but electrically series-connected) straight fluorescent lamps; as U-bent or circular fluorescent lamps; etc. That is to say: the lamp assemblies may be provided in the form of lighting strips, lighting panels, etc.

(h) Again with respect to FIGS. 9 and 10, if a lamp assembly is arranged to include plural individual fluorescent lamps, it is anticipated that a simple shorting-switch means be provided whereby one or more of the plural lamps may be shorted. That way, light output control may be achieve in a very simple and cost-effective manner.

(i) It is thought that the present invention and many of its attendant advantages will be understood from the foregoing description and that many changes may be made in the form and construction of its components parts, the form described being merely a preferred embodiment of the invention.

What is claimed is:

1. A gas discharge lighting system comprising:

a source operative to provide a source voltage at a pair of source terminals; and a first and a second gas discharge lighting means; the first gas discharge lighting means having a first pair of input terminals and a first pair of output terminals; the second gas discharge lighting means having a second pair of input terminals; the first pair of input terminals being connected with the source terminals by way of a first connect means; the second pair of input terminals being disconnectably connected with the first pair of output terminals by way of a second connect means; a first voltage existing across the first pair of input terminals; a second voltage existing across the second pair of input terminals, but only when the second pair of input terminals are indeed connected with the first pair of output terminals; the first voltage having a first magnitude; the second voltage having a second magnitude; the first magnitude being equal to the magnitude of the source voltage; the second magnitude being substantially lower than the first magnitude.

2. The system of claim 1 wherein, whenever the second pair of input terminals are not connected with the first pair of output terminals, the magnitude of any voltage existing across the first pair of output terminals is substantially equal to zero.

3. The system of claim 1 wherein the first connect means includes a switch means.

4. The system of claim 1 wherein the first gas discharge lighting means includes a shorting means connected with the first pair of output terminals; the shorting means being operative to cause an electrical short circuit to exist between the first pair of output terminals except when the second pair of input terminals is indeed connected therewith.

5. The system of claim 1 wherein: (i) the second lighting means has a second pair of output terminals; (ii) the second pair of output terminals is connected with a second receptacle means; (iii) the second receptacle is operative to receive and hold a special plug means; and (iv) an electrical short circuit exists between the second pair of output terminals except for as long as said special plug means is being held by the second receptacle means.

6. The system of claim 1 wherein: (i) the first connect means includes disconnect means operative to under certain conditions to cause disconnection between the source terminals and the first pair of input terminals; and (ii) the magnitude of the source voltage is substantially higher when the first pair of input terminals is indeed connected with the source terminals as compared with a situation where the first pair of input terminals is not connected with the source terminals.

7. The system of claim 1 wherein the magnitude of the source voltage is higher when the second pair of input terminals is indeed connected with the first pair of output terminals as compared with a situation where it is not so connected.

8. The system of claim 1 wherein: (i) the source exhibits a source output impedance as measured across its source terminals; (ii) the first gas discharge lighting means has a load input input impedance as measured across its first pair of input terminals; (iii) the source output impedance includes an inductive reactance; and (iv) the load input impedance includes a capacitive reactance.

9. The system of claim 8 wherein: (i) the source voltage has a fundamental frequency; and (ii) the inductive reactance and the capacitive reactance resonantly interact at this fundamental frequency.

10. The system of claim 1 wherein: (i) the first lighting means includes a first fluorescent lamp through which flows a first lamp current; (ii) the second lighting means includes a second fluorescent lamp through which conditionally flows a second lamp current; (iii) the second lamp current, when it does indeed flow, is substantially identical to the first lamp current.

11. The system of claim 1 wherein: (i) the first lighting means includes a first fluorescent lamp; (ii) the second lighting means includes a second fluorescent lamp; and (iii) the second fluorescent lamp is connected in series with the first fluorescent lamp whenever the second pair of input terminals is indeed connected with the first pair of output terminals.

12. The system of claim 1 wherein: (i) the first lighting means includes a first fluorescent lamp having a first pair of lamp terminals; and (ii) a capacitor is connected across the first pair of lamp terminals.

13. A gas discharge lighting system comprising:

a source operative to provide a source voltage at a pair of source terminals;

a gas discharge lighting means having a pair of input terminals as well as an output receptacle means having a pair of output terminals; the pair of input terminals being connected with the source terminals by way of a connect means; a first voltage existing across the pair of input terminals; an electrical short circuit existing between the output terminals except if a special plug were to be inserted into the output receptacle means; and a plug means functional to be inserted into the output receptacle means, thereby to function as said special plug.

14. The system of claim 13 wherein the gas discharge lighting means additionally includes a capacitive reactance means connected across the input terminals.

15. The system of claim 13 wherein: (i) the connect means includes a disconnect means; (ii) the source voltage has a magnitude; and (iii) this magnitude is substantially larger when the input terminals are indeed connected with the source terminals as compared with a situation where the input terminals are not so connected.

16. A lamp assembly comprising:

a first and a second input terminal;

a first and a second output terminal; the first output terminal being connected with the first input terminal; the first and second output terminal being connected together except when being separated by means of a separation means; the separation means being optionally insertable between the first and second output terminal as well as optionally removable from between the first and second output terminal; and a gas discharge lamp having a first and a second lamp terminal; the first lamp terminal being connected with the second input terminal; the second lamp terminal being connected with the second output terminal.

17. The lamp assembly of claim 16 wherein an impedance means, other than the gas discharge lamp, is connected between the first and the second input terminal.

18. The lamp assembly of claim 17 wherein the impedance means includes a capacitor.

19. The lamp assembly of claim 16 combined with a second lamp assembly; the second lamp assembly having input terminal means operative to connect with the first and the second output terminal as well as, when indeed so connected, to function as said separation means.

20. An arrangement comprising:

a source operative to provide a current-limited AC voltage at a set of AC output terminals; the frequency of the AC voltage being substantially higher than that of the voltage on an ordinary electric utility power line;

plural lighting assemblies; each lighting assembly having a power input plug means and a power output receptable means; the power input plug means of one of said lighting assemblies being plugged into and connected with the power output receptable means of another one of the lighting assemblies; each power output receptacle means including a short circuit except when having received the power input plug means of one of the lighting assemblies; and a special lighting assembly having power input means connected with the AC power output terminals as well as a power output receptacle means into which is plugged the power input plug means of one of the plural lighting assemblies.

21. An arrangement comprising:

a source operative to provide a high-frequency approximately sinusoidal voltage at a first output port; and a number of lamp assemblies; each lamp assembly having a gas discharge lamp; one of the lamp assemblies being connected with said first output port, thereby to cause a high-frequency current to flow through its gas discharge lamp; said one of the lamp assemblies also having a second output port operative to receive and hold a power plug and to supply power thereto; one of the other lamp assemblies having such a power plug and being operative, as long as this power plug is indeed plugged into said second output port, to cause high-frequency current to flow through its associated gas discharge lamp; all the power used by said number of lamp assemblies being drawn from the first output port by said one of the lamp assemblies.

22. The arrangement of claim 21 wherein the amount of power available from the first output is limited to a level sufficiently low to be substantially free of fire initiation hazard.

23. The arrangement of claim 21 where the first source is characterized by having a housing integrally combined with a pair of prongs, thereby to permit it to be plugged into and held by an ordinary household electric receptacle.

24. A gas discharge lighting system comprising:

a source conditionally operative to provide a source voltage at a pair of source terminals; the source voltage being provided only when a certain load is connected with the source terminals; no voltage being provided at the source terminals when said certain load is not so connected; the source having an internal impedance functional to prevent the magnitude of any current drawn from the source terminals from exceeding a pre-determined level; and a first gas discharge lighting assembly having a first pair of input terminals operative to connect with the source terminals; the first gas discharge lighting assembly being functional, when indeed so connected, to constitute said certain load, thereby causing said source voltage to be provided across the first pair of input terminals.

25. The system of claim 24 wherein: (ii) a second gas discharge lighting means has a second pair of input terminals including a second plug means; (ii) the first gas discharge lighting means includes a first receptacle means operative to receive the second plug means; (iii) the second plug means has indeed been plugged into and received by the first receptacle means; (iv) the source voltage has a first magnitude; (v) a second voltage exists across the second pair of input terminals; (vi) the second voltage has a second magnitude; and (vii) the first magnitude is larger than the second magnitude.

26. The system of claim 24 wherein the first gas discharge lighting means includes a capacitor means connected across the first pair of input terminals.

27. The system of claim 24 wherein: (i) the source includes a frequency-converting power supply connected with the power line voltage of an ordinary electric utility power line; and (ii) the fundamental frequency of the source voltage is substantially higher than that of the power line voltage.

28. The system of claim 27 wherein the frequency-converting power supply is characterized by being integrally and rigidly combined with a power plug means operative to be plugged into and held by an ordinary household electric receptacle.

29. An arrangement comprising:

plural gas discharge lighting assemblies; each lighting assembly including a gas discharge lamp as well as a power input port and a power output port; the power output port of a first lighting assembly being operative to connect with the power input port of a second lighting assembly; any power supplied to the power input port of the second lighting assembly being supplied from the power output port of the first lighting assembly;

frequency-converting power supply operative to be powered from ordinary power line voltage and to provide a supply voltage at a main power output port; the supply voltage having an approximately sinusoidal waveform and being of frequency substantially higher than that of the power line voltage; and a pair of conductors connected between the main power output port and the first power input port, thereby to supply to the first power input port all the power drawn by the plural lighting assemblies.

30. An arrangement comprising:

a frequency-converting power source operative conditionally to provide an approximately sinusoidal output voltage at a set of source terminals; the approximately sinusoidal output voltage having a magnitude lower than a certain level when no current is flowing from the source terminals; the approximately sinusoidal output voltage having a magnitude higher than said certain level when a current-drawing load is connected with the source terminals, thereby exhibiting a voltage-versus-current loading characteristic opposite to that of an ordinary power source supplying power from a pair of output terminals; and a gas discharge lamp assemblage having lamp input terminals operative to connect with the source terminals and being operative, when indeed so connected, to constitute said current-drawing load.

31. The arrangement of claim 30 wherein the gas discharge lamp assemblage includes a set of lamp output terminals functional to connect with a set of input terminals of an auxiliary load.

32. The arrangement of claim 31 wherein the auxiliary load also includes a gas discharge lamp as well as a set of output terminals functional to connect with a set of input terminals from another auxiliary load.

33. The arrangement of claim 30 wherein the gas discharge lamp assemblage includes a master lamp assembly as well as plural individual lamp assemblies; the master assembly including the lamp input terminals as well as the lamp output terminals; each lamp assembly having a set of lamp assembly input terminals and a set of lamp assembly output terminals; the plural lamp assemblies being operable to be series-connected with one another in such manner that the lamp assembly input terminals of one lamp assembly connect with the lamp assembly output terminals of another lamp assembly; the lamp output terminals being operable to connect with the lamp assembly input terminals of one of the plural lamp assemblies.

34. An arrangement comprising:

a power supply connected with a power line voltage and operative to provide, at a main power output port, an approximately sinusoidal output voltage of frequency distinctly higher than that of the power line voltage; and plural gas discharge lamp assemblies; each gas discharge lamp assembly including a gas discharge lamp as well as a power input port and a power output port; a first one of the gas discharge lamp assemblies having a first power input port and a first power output port, the first power input port being connected with the main power output port; a second one of the gas discharge lamp assemblies having a second power input port and a second power output port, the second power input port being connected with the first power output port; each of the plural gas discharge assemblies using electric power to generate luminous output by way of its associated gas discharge lamp; substantially all the electric power drawn by all the gas discharge lamp assemblies being supplied to the first power input port from the main power output port.

35. The arrangement of claim 34 wherein at least one of the plural gas discharge lamp assemblies has at least one electric conductor directly connected between its power input port and its power output port.

36. The arrangement of claim 34 wherein said second power input port includes an electric plug assembly functional to effectuate plug-in connection with said first power output port.

37. The arrangement of claim 34 wherein the electric power supplied to the first power input port from the main power output port is supplied via no more than two electrical conductors.

38. The arrangement of claim 34 wherein each gas discharge lamp assembly has a longitudinal dimension, and has its power input port located at one end of this longitudinal dimension and its power output port located at the other end of this longitudinal dimension.

39. The arrangement of claim 34 wherein each gas discharge lamp assembly has an input end and an output end; the input end being characterized by including its power input port; the output end being characterized by including its power output port.

40. The arrangement of claim 39 wherein, for each gas discharge lamp assembly, its gas discharge lamp is disposed between its input end and its output end.

41. The arrangement of claim 34 wherein the plural gas discharge lamp assemblies are further characterized in that: (i) the first power input port includes a first electrical input terminal; (ii) the second power output port includes a second electrical output terminal; and (iiii) an electrical short circuit exists between the first electrical input terminal and the second electrical output terminal.

* * * * *